United States Patent [19]

Mizushina

[11] Patent Number: 4,695,706

[45] Date of Patent: Sep. 22, 1987

[54] VERTICAL FURNACE FOR HEAT-TREATING SEMICONDUCTOR

[75] Inventor: Youichi Mizushina, Kawasaki, Japan

[73] Assignee: Denkoh Co. Ltd., Oume, Japan

[21] Appl. No.: 871,683

[22] Filed: Jun. 9, 1986

Related U.S. Application Data

[62] Division of Ser. No. 686,231, Dec. 26, 1984, Pat. No. 4,610,628.

[30] Foreign Application Priority Data

Dec. 28, 1983 [JP] Japan ..... 58-201329
Nov. 6, 1984 [JP] Japan ..... 59-232397

[51] Int. Cl.[4] ..... H05B 3/62; F27B 9/06; F27B 9/20

[52] U.S. Cl. ..... 219/390; 219/388; 219/411; 414/172; 118/725; 118/729; 118/50.1

[58] Field of Search ..... 219/390, 388, 405, 411, 219/354; 118/50.1, 724, 725, 728, 729; 432/6, 152, 253, 241; 187/20, 27; 414/160, 172, 147; 126/275 E

[56] References Cited

U.S. PATENT DOCUMENTS

| | | | |
|---|---|---|---|
| 1,824,310 | 9/1931 | Thompson | 126/275 E |
| 2,332,943 | 10/1943 | Sobers | 219/521 |
| 2,344,035 | 3/1944 | Etten | 432/124 |
| 2,940,745 | 6/1960 | Grieger | 432/253 |
| 3,081,988 | 3/1963 | Hess | 432/253 |
| 3,342,161 | 9/1967 | Heim | 118/725 |
| 3,441,652 | 4/1969 | Eicker | 219/390 |
| 3,749,383 | 7/1973 | Voigt | 118/729 |
| 4,412,812 | 11/1983 | Sadowski | 432/253 |
| 4,524,719 | 6/1985 | Campbell | 118/725 |

FOREIGN PATENT DOCUMENTS

| | | | |
|---|---|---|---|
| 411041 | 5/1934 | United Kingdom | 219/390 |

*Primary Examiner*—E. A. Goldberg
*Assistant Examiner*—Teresa J. Walberg
*Attorney, Agent, or Firm*—Pearne, Gordon, McCoy & Granger

[57] ABSTRACT

A vertical furnace for heat-treating a semiconductor is capable of effectively and safely accomplishing the heat-treating of a semiconductor. The vertical furnace includes a furnace section which is opened at the lower end thereof to allow a boat for supporting a semiconductor thereon to be introduced and removed through the lower opened end with respect to the furnace section. Also, a vertical furnace is adapted to effectively prevent a semiconductor from being polluted by dust in an operation space.

5 Claims, 2 Drawing Figures

VERTICAL FURNACE FOR HEAT-TREATING SEMICONDUCTOR

This is a division of application Ser. No. 686,231, filed Dec. 26, 1984, now U.S. Pat. No. 4,610,628.

BACKGROUND OF THE INVENTION

1. Field of the Invention

This invention relates to a vertical furnace for heat-treating a semiconductor, and more particularly to such a vertical furnace which is adapted to effectively and positively carry out the heat-treating of a semiconductor.

2. Description of the Prior Art

A conventional furnace for heat-treating a semiconductor which is known as a diffusion furnace in the art is typically the horizontal type constructed in such a manner as shown in FIG. 1. More particularly, the conventional heat-treating furnace is constructed to dispose a heater 20 on the inner wall of a furnace body 18 which is formed into a cylindrical shape and laterally arranged. In the conventional furnace of such horizontal type, a material 52 to be heat-treated is put on a boat 14, which is driven by a driving means or motor 28 to be reciprocated in the directions indicated by arrows.

However, the conventional heat-treating furnace of the horizontal type described above has many disadvantages of, for example, being inferior in heat efficiency, requiring a large area for the installation, being nonuniform in temperaure profile in the furnace, being troublesome in handling of a material to be subjected to heat-treating, and the like.

In order to effectively eliminate the above-described defects of the conventional horizontal type furnace, a vertical furnace for heat-treating a semiconductor has been proposed which is open at the upper end thereof. However, such a conventional vertical furnace of the top open type has a disadvantage that heat loss easily occurs because of the upper end being open. The vertical furnace has another problem that heat discharged from the furnace due to convection renders the operation of holding on a holder a material to be subjected to heat-treating in the upper portion of the furnace highly difficult. A further disadvantage of the furnace is that the falling of the holder due to, for example, misoperation often causes a silica tube to be damaged or broken. The furnace has still a further defect in that it is highly difficult to remove from the furnace dust produced due to the above-described holding operation.

Also, the conventional vertical furnace is constructed in a manner such that a boat driving mechanism for carrying out the introduction and removal of a boat with respect to a furnace section is substantially arranged in an operation spaced, resulting in a semiconductor heat-treated or to be subjected to heat-treating being polluted by dust produced due to the operation of the boat driving mechanism, and more particularly the rotation of a driving motor, the engagement of a driving shaft with a connecting member and the like.

SUMMARY OF THE INVENTION

The present invention has been made in view of the foregoing disadvantages of the prior art.

In accordance with the present invention, there is provided a vertical furnace for heat-treating a semiconductor comprising a furnace section formed into a cylindrical shape and substantially vertically arranged, said furnace section being closed at the upper end thereof and open at the lower end thereof and having a heater means disposed on the inner wall thereof; a boat means adapted to support a semiconductor thereon so as to allow said semiconductor to be subjected to heat-treating in said furnace section; a boat supporting means for supporting said boat means thereon; a connecting means connected to said boat supporting means; a boat driving means for vertically moving said boat supporting means via said connecting means to permit the introduction and removal of said boat means with respect to said furnace section to be carried out through the lower open end of said furnace section; an operation space defined below said furnace section so as to allow the charging and discharge operations of said semiconductor with respect to said boat means to be carried out in said operation space; and a separating means arranged below said furnace section and formed with an opening positionally corresponding to the lower open end of said furnace section; said separating means being adapted to separate a space around said furnace body from said operation space; said boat driving mechanism being arranged at the outside of said operation space through said separating means so as to be isolated from said operation space; said connecting means being movably inserted through said separating means.

In a preferred embodiment, said opening of said separating means is positioned in close proximity to said lower open end of said furnace section.

In a preferred embodiment, said connecting means comprises a vertically moving shaft vertically arranged to be laterally spaced from said furnace section and vertically movably extend through said separating means and a supporting member fixedly connected to the lower end of said vertically moving shaft to support said boat supporting means; and said boat driving means comprises a driving motor arranged to move said vertically moving shaft.

In a preferred embodiment, said vertically moving shaft is airtightly inserted through said separating means.

In a preferred embodiment, said connecting means comprises a vertically moving shaft vertically arranged so as to be laterally spaced from said furnace section and vertically movably extend through said separating means and a supporting member fixedly mounted on the lower end of said vertically moving shaft to support said boat supporting means thereon; and said boat driving means comprises a pulley arranged above said vertically moving shaft, a take-up roller arranged to be laterally spaced from said pulley, a wire or belt means stretched between the upper end of said vertically moving shaft and said take-up roller through said pulley so as to be wound up on said take-up roller as desired, and a motor for rotating said take-up roller.

Accordingly, it is an object of the present invention to provide a vertical furnace for heat-treating a semiconductor which is capable of substantially reducing heat loss from the interior of the furnace due to convection to effectively improve heat efficiency.

It is another object of the present invention to provide a vertical furnace for heat-treating a semiconductor which is adapted to allow an operator to safely accomplish the operation for charging or discharging a semiconductor with respect to a boat below a furnace section without being exposed to heat discharged due to convection from the furnace section.

It is another object of the present invention to provide a vertical furnace for heat-treating which is capable of effectively preventing the interior of a furnace section from being damaged and/or broken due to the falling of an object in the furnace section by misoperation or the like.

It is a further object of the present invention to provide a vertical furnace for heat-treating a semiconductor which is capable of preventing the collection of dust in a furnace section and facilitating the cleaning of the furnace section.

It is still a further object of the present invention to provide a vertical furnace for heat-treating a semiconductor which is capable of positively keeping an atmosphere in an operation space clean to effectively prevent a semiconductor to be subjected to heat-treating from being polluted by dust in the operation space.

Still other objects and advantages of the invention will in part be obvious and will in part be apparent from the specification.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, references had to the following description taken in connection with the accompanying drawings in which like reference numerals designate like or similar parts throughout, wherein.

DETAILED DESCRIPTION OF THE PREFERRED EMBODIMENT

Now, a vertical furnace for heat-treating a semiconductor according to the present invention will be described hereinafter with reference to the accompanying drawings.

Figure 1:
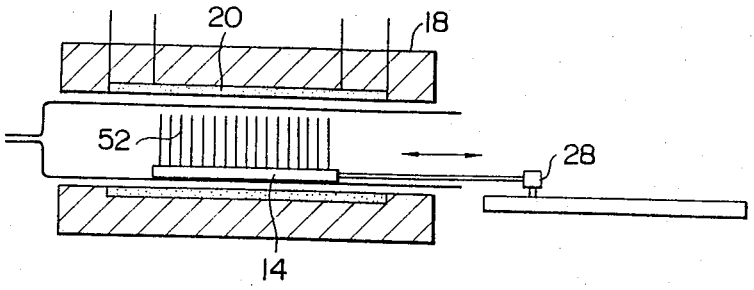
FIG. 1 PRIOR ART
FIG. 1 is a vertical sectional view showing a conventional prior art horizontal furnace for heat-treating a semiconductor.
Figure 2:
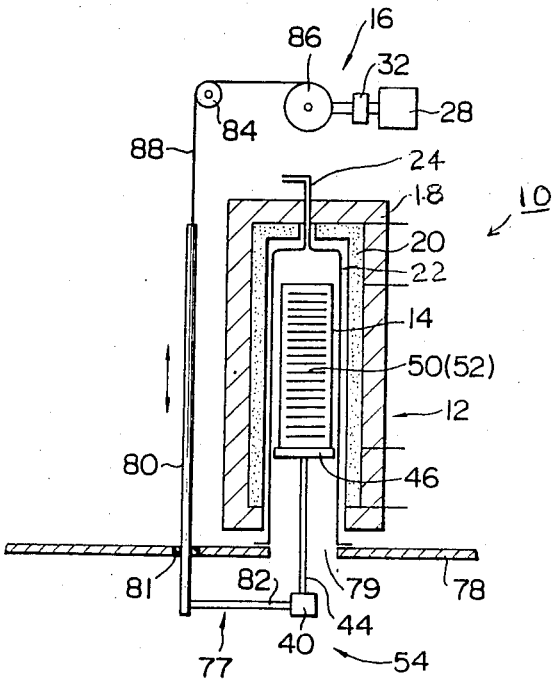
FIG. 2 is a vertical sectional view showing a vertical furnace for heat-treating a semiconductor according to the present invention.

FIG. 2 shows one embodiment of a vertical furnace for heat-treating a semiconductor according to the present invention, wherein a heat-treating furnace is generally designated by reference numeral 10.

The heat-treating furnace 10 of the illustrated embodiment comprises a furnace section 12, a boat means 14 arranged in the furnace section 12 on which semiconductors to be heat-treated are to be put, and a driving mechanism 16 for carrying out the introduction and removal of the boat means 14 with respect to the furnace section 12.

The furnace section 12 includes a furnace body 18 which is formed into a cylindrical shape and vertically arranged. The furnace body 18 is closed at the upper end thereof and open at the lower end thereof. The furnace section 12 also includes a heater 20 disposed on the inner wall of the furnace body 18 and a silica tube 22 arranged in the furnace body so as to be spaced at an interval from the heater 20. The silica tube 22 is opened at the lower end thereof and communicated at the upper end thereof with a gas feed pipe 24 inserted into the furnace body 18 through the top wall thereof.

The driving mechanism 16 for carrying out the introduction and removal of the boat means 14 with respect to the interior of furnace section 12 and more particularly the interior of the silica tube includes connecting means 77 which include a horizontal supporting arm 82 connected by a connecting member 40 to a vertical rod 44 which mounts supporting means or stand 46. The driving means 16 includes a pulley 84 arranged above a vertically moving shaft 80 of the connecting means 77, a take-up roller 86 provided in a manner to be laterally spaced from the pulley 84 and connected through a reducer 32 to a driving motor 28, and a wire or belt 88 which is connected at both ends thereof to the upper end of the vertically moving shaft 80 and the take-up roller 86 through the pulley 84, respectively.

The boat means 14 is supported on the supporting means or stand 46. In the illustrated embodiment, the boat means is formed of silica and has a plurality of shelf boards or trays 50 formed therein which are adapted to put thereon or receive therein semiconductor wafers 52 to be subjected to heat-treating.

The manner of operation of the vertical furnace 10 of the illustrated embodiment constructed in the manner as described above will be hereinafter described with reference to FIG. 2.

When semiconductor wafers 52 are put on the silica boat and the silica boat 14 is introduced into the furance section 12 as shown in FIG. 2, reactive gas is fed through the gas feed pipe 24 to the silica tube 22 and the heater 20 is turned on, so that the semiconductor wafers 52 are subjected to heat-treating. Upon completion of the heat treatment, the shaft 44 is moved downwardly to draw out the boat 14 from the furnace section 12 and then the semiconductor wafers are taken out from the boat.

Then, semiconductor wafers to be subjected to subsequent heat-treating are put on the silica boat 14, and the shaft 44 is moved upwardly. This results in the silica boat 14 which has semiconductor wafers supported thereon being introduced into the furnace section 12 for heat-treating.

In the embodiment illustrated in FIG. 2, the silica boat 14 is supported on the boat supporting stand 46 which is adapted to be moved by the driving mechanism 16. However, the embodiment may be constructed in a manner such that the boat is suspendedly supported by a wire means downward loosely inserted through the upper closed wall of the furnace body 18 and the wire means is wound on a roller provided above the furnace body 18 to be reversibly rotated by a motor, so that the boat may be vertically moved.

As can be seen from the foregoing, the vertical furnace of the illustrated embodiment can significantly reduce heat loss of the furnace due to convection, facilitate the operation of charging semiconductors in the boat without exposing an operator to heat from the furnace due to convection, prevent the damage of the interior of the furnace due to the falling of an object in the furnace section by mistake, and effectively prevent the collection of dust in the furnace body.

The embodiment shown in FIG. 2 is adapted to keep an operation space clean to positively prevent a semiconductor from being polluted by dust during the operation in the operation space.

The boat driving mechanism 16 is supported on a horizontal separating plate 78 which is arranged in proximity to the lower end of the furnace section 12 and above an installation table, not shown, so as to define an operation space 54 between the separating plate 78 and the installation table. The operation space 54 is formed to have a size sufficient to allow the charging and discharge of semiconductor wafers 52 with respect to the silica boat 14 or the trays 50 of the boat and the introduction and removal of the boat with respect to the furnace section 12 to be smoothly carried out. The separating plate 78 is abutted at one end portion thereof against the upper end of a dust filter, not shown, and formed with an opening 79 having the substantially same diameter as the silica tube 22 at the portion thereof right below the furnace section 12, of which the periphery is substantially contiguous to the lower end of the silica tube 22 to substantially isolate a space around the furnace section from the operation space 54.

The boat driving mechanism 16 is arranged on the separating plate 78 to be substantially isolated from the operation space 54 by the separating plate 78. The vertical shaft 80 is fitted in the separating plate 78 through an O-ring 81 so as to be airtight with respect to the separating plate.

The dust filter, not shown, is fixedly mounted on the installation table, not shown, to clean air to be supplied from the exterior therethrough to the operation space 54 by means of an air fan, not shown.

In operation, dust generated due to the actuation of the boat driving mechanism 16 is blocked by the separating plate 78 to be prevented from entering the operation space 54, resulting in the operation space being kept clean.

Thus, it will be noted that the illustrated embodiment can effectively prevent a semiconductor heat-treated or to be subjected to heat-treating from being polluted by dust in the operation space 54.

In the vertical furnace of FIG. 2 constructed in the manner as described above, the take-up roller 86 is rotated through the reducer 32 by the driving motor 28 to carry out the winding or release of the wire 88 with respect to the take-up roller, to thereby vertically move the vertically moving shaft 80 through the wire or belt 88. This results in the silica boat 14 being vertically moved with respect to a furnace section 12.

It will thus be seen that the object set forth above, are those made apparent from the preceding description, are effectively attained and, since certain changes may be made in the above construction without departing from the spirit and scope of the invention, it is intended that all matter contained in the above description shown in the accompanying drawings shall be interpreted as illustrative and not in a limiting sense.

It is also to be understood that the following claims are intended to cover all the generic and specific features of the invention herein described and statements of the scope of the invention which, as a matter of language, might be said to fall therebetween.

What is claimed is:

1. A vertical furnace for heat-treating a semiconductor comprising:

a furnace body formed into a cylindrical shape and substantially vertically arranged, said furnace body being closed at the upper end thereof and open at the lower end thereof and having a heater means disposed on the inner wall thereof;

a boat means adapted to support a semiconductor thereon so as to allow said semiconductor to be subjected to heat-treating in said furnace body;

a boat supporting means for supporting said boat means thereon;

a connecting means connected to said boat supporting means;

a boat driving means for vertically moving said boat supporting means through said connecting means to permit the introduction and removal of said boat means with respect to said furnace body to be carried out through the lower open end of said furnace body;

an operation space defined below said furnace body so as to allow the charging and discharge operations of said semiconductor with respect to said boat means to be carried out in said operation space;

a separating means for airtightly isolating said operation space from a space around said furnace body, said separating means being arranged below said furnace body and formed with an opening positionally corresponding to the lower open end of said furnace body, said separating means also airtighly isolating said operation space from said boat driving means;

said connecting means including a vertically movable shaft vertically arranged so as to be laterally spaced from said furnace body and vertically movably extending through said separating means in an airtight manner and a supporting member fixedly mounted on the lower end of said vertically movable shaft to support said boat supporting means thereon; and said boat driving means including a pulley arranged above said vertically movable shaft, a take-up roller arranged to be laterally spaced from said pulley, a wire or belt means stretched between the upper end of said vertically movable shaft and said take-up roller through said pulley so as to be wound up on said take-up roller as desired, and a motor for rotating said take-up roller.

2. A vertical furnace for heat-treating a semiconductor comprising:

a substantially vertical furnace body closed at the upper end thereof and open at the lower end thereof and having a heater means disposed therewithin:

boat means adapted to support a semiconductor thereon so as to allow said semiconductor to be subjected to heat-treating in said furnace body;

boat supporting means for supporting said boat means thereon;

connecting means connected to said boat supporting means;

boat driving means for vertically moving said boat supporting means through said connecting means to permit the introduction and removal of said boat means with respect to said furnace body to be carried out through the lower open end of said furnace body;

an operation space defined below said furnace body so as to allow the charging and discharge operations of said semiconductor with respect to said boat means to be carried out in said operation space;

separating means for airtightly isolating said operation space from a space around said furnace, said separating means arranged below said furnace body and formed with an opening positionally corresponding to the lower open end of said furnace body, said separating means also airtightly isolating said operation space from said boat driving means;

said connecting means including a vertically movable shaft vertically arranged so as to be laterally spaced from said furnace body and vertically movably extending through said separating means in an airtight manner and a supporting member fixedly mounted on the lower end of said vertically movable shaft to support said boat supporting means thereon;

said boat driving means including a take-up roller arranged above said separating means;

a wire or belt means stretched between the upper end of said vertically movable shaft of said connecting means and said take-up roller so as to be wound up on said take-up roller as desired; and a motor for reversibly rotating said take-up roller to raise and lower said boat means.

3. A vertical furnace as defined in claim 2, wherein said boat driving means includes a pulley arranged above said vertically movable shaft, and said wire or belt means connected from said take-up roller over said pulley to the upper end of said vertically movable shaft.

4. A vertical furnace as defined in claim 2, wherein said connecting means comprises a vertically movable shaft vertically arranged so as to be laterally spaced from said furnace body and vertically movably extending through said separating means and a supporting member fixedly mounted on the lower end of said vertically movable shaft to support said boat supporting means thereon.

5. A vertical furnace as defined in claim 4, wherein said vertically movable shaft is airtightly inserted through said separating means.

* * * * *